US007726407B2

(12) United States Patent
Wood et al.

(10) Patent No.: US 7,726,407 B2
(45) Date of Patent: Jun. 1, 2010

(54) ANCHOR SYSTEM FOR PACKERS IN WELL INJECTION SERVICE

(75) Inventors: Edward T. Wood, Kingwood, TX (US); Bennett M. Richard, Kingwood, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 203 days.

(21) Appl. No.: 11/453,406

(22) Filed: Jun. 15, 2006

(65) Prior Publication Data

US 2007/0289749 A1 Dec. 20, 2007

(51) Int. Cl.
*E21B 33/124* (2006.01)

(52) U.S. Cl. ..... 166/387; 166/191; 166/382

(58) Field of Classification Search ..... 166/191, 166/227, 387, 382
See application file for complete search history.

(56) References Cited

U.S. PATENT DOCUMENTS 3,137,349 A * 6/1964 Garrett ..... 166/196
3,912,006 A 10/1975 Nutter
4,714,117 A * 12/1987 Dech ..... 166/380
5,165,478 A 11/1992 Wilson
5,178,219 A 1/1993 Striech et al.
5,224,556 A 7/1993 Wilson
5,228,518 A 7/1993 Wilson
5,346,016 A 9/1994 Wilson et al.
5,379,838 A 1/1995 Wilson et al.
5,411,094 A * 5/1995 Northrop ..... 166/303
5,692,564 A * 12/1997 Brooks ..... 166/127
5,829,520 A 11/1998 Johnson
2004/0040707 A1 3/2004 Dusterhoft et al.
2004/0099423 A1* 5/2004 Badrak et al. ..... 166/380
2005/0194151 A1* 9/2005 Dewey et al. ..... 166/382
2006/0108114 A1 5/2006 Johnson

OTHER PUBLICATIONS

Baker Hughes, Baker Oil Tools, Liner Hangers Technical Unit, RS Nipple, Retrievable Stuffing Box, Slick Joint for Retrievable Stuffing Box; Feb. 19, 2004, pp. 1-2, 6, 9, 11-12.

Cundiff, David W., "Open/Cased Hole Inflatable Whipstock Anchor", SPE 67261, Mar. 2001, 1-12.

Durst, Doug G., et al., "Advanced Open Hole Multilaterals", IADC/SPE 77199, Sep. 2002, 1-8.

(Continued)

*Primary Examiner*—David J Bagnell
*Assistant Examiner*—Sean D Andrish
(74) *Attorney, Agent, or Firm*—Steve Rosenblatt

(57) ABSTRACT

An isolation assembly for downhole injection use is described that features at least one isolation device mounted on a tubular so that when injection fluid changes the tubular temperature which can cause a length change in the tubular, an anchor for the tubular is provided to resist such a dimension change. The result is that the isolation device such as a packer can be left undamaged and retaining its sealing integrity. The anchor can be an inflatable or telescoping pistons disposed to grab in open hole. When using telescoping pistons, their placement on the liner and their pattern can meet the desired locations where grip is enhanced. Use of cement inflatable anchors is contemplated as an alternative.

15 Claims, 2 Drawing Sheets

OTHER PUBLICATIONS

Al-Dubais, A.M., et al., "Field Cases to Demonstrate Application of Through Tubing Inflatable Anchoring Packer to Selectively Stimulate Vertical Dump Water Injector Wells with Cross Flowing Zones", SPE 88590, Oct. 2004, 1-8.

Constantine, Jesse J., "Selective Production of Horizontal Openhole Completions Using ECP and Sliding Sleeve Technology", SPE 55618, May 1999, 1-5.

* cited by examiner

ANCHOR SYSTEM FOR PACKERS IN WELL INJECTION SERVICE

FIELD OF THE INVENTION

The field of this invention is anchors for packers and more particularly packers that isolate a zone for fluid injection where significant well temperature changes can result in loss of packer grip

BACKGROUND OF THE INVENTION

Wells are sometimes drilled into a formation so that fluids can be injected into that formation to stimulate production into another well that is drilled into that same formation. These wells are called injection wells. Typically, the injection well is cased and a liner is suspended with a hanger from the cemented casing above. The liner is perforated and one or more zones in the zone in question are isolated with barriers such as packers. The injection fluid is applied between barriers into the formation in question for injection into the formation to stimulate production through another well in that same formation.

The problem that occurs is that the injected fluid between the barriers and into a formation is generally significantly colder than ambient formation temperature. As a result of long periods of injection, the temperature of the liner pipe that supports the isolation packers or other barriers used to direct the injection flow begins to change to the injection temperature. This usually means that the liner between packers cools and as a result shrinks. Just how much is a function of the coefficient of thermal expansion or contraction for the given material of the liner and the temperature difference. It is not unforeseen to have contraction in the order of 0.3 inches per 20 foot of liner length for a temperature difference of greater than 100 degrees Centigrade. Temperature changes of at least 50 degrees Centigrade are all too common. When fairly large packer spacing is employed, the amount of liner shrink can be significant enough to pull one or both packers loose or damage one or more of the packers to the point where they don't hold a seal. Testing has shown that the amount of force required to impose a counteracting tensile force to cancel out the shrinkage effect could be an axial force in the order of over 50,000 thousand pounds.

Telescoping cylinders have been used downhole for centralizing a tubular in a wellbore to leave an annular space around the tubular for a good cement job. These telescoping cylinders can be pushed out when the tubular is in position. Some illustrations of this type of centralizing system can be found in U.S. Pat. Nos. 5,228,518; 5,346,016; 5,379,838; 5,224,556; and 5,165,478. In yet another application, these cylinders have been designed with removable barriers to let flow go through them after extension. Extendable elements with flow passages and screens are illustrated in US Publication Number 2006/0108114 A1. In that respect they eliminated a perforating step for casing. Telescoping pistons have also been designed with sensors and are illustrated in U.S. Pat. No. 5,829,520.

The present invention addresses the damage and loss of seal risk to isolation packers in injection service by resisting the induced thermal forces to hold the liner supporting the packers against dimension change that can damage them or make them lose seal through axial movement. These and other advantages of the present invention will become more apparent to those skilled in the art from a review of the description of the preferred embodiment and the drawings that appear below while recognizing that the claims fully define the scope of the invention.

SUMMARY OF THE INVENTION

An isolation assembly for downhole injection use is described that features at least one isolation device mounted on a tubular so that when injection fluid changes the tubular temperature which can cause a length change in the tubular, an anchor for the tubular is provided to resist such a dimension change. The result is that the isolation device such as a packer can be left undamaged and retaining its sealing integrity. The anchor can be an inflatable or telescoping pistons disposed to grab in open hole. When using telescoping pistons, their placement on the liner and their pattern can meet the desired locations where grip is enhanced. Use of cement inflatable anchors is contemplated as an alternative.

DETAILED DESCRIPTION OF THE PREFERRED EMBODIMENT

Figure 1:
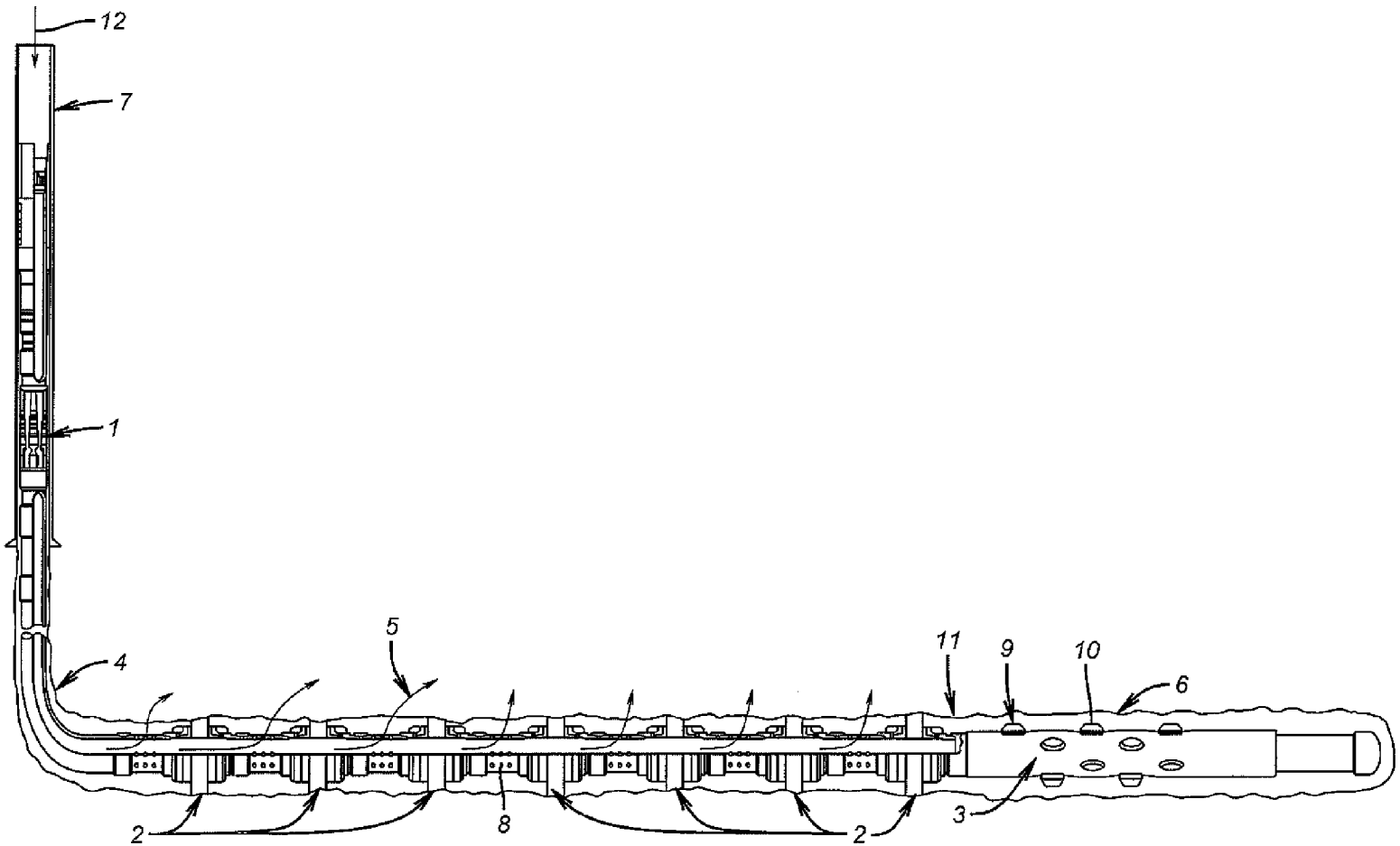
FIG. 1 is a section view showing multiple pairs of isolation packers where injection occurs between them and an anchor with telescoping members is used to minimize the risk of damage or loss of seal of the packers due to stresses from temperature changes to the tubular supporting the packers.

FIG. 1 shows a wellbore 6 that has had a casing 7 installed and cemented. A liner 4 is suspended from casing 7 with liner hanger 1. Spaced isolators such as packers 2 allow pumped injection fluid 5 to go through openings 8 in liner 4 between packers 2. Since the injected fluid 5 is commonly at a significantly different temperature than well ambient, the change in temperature of the liner 4 between packers 2 can force it to shrink if the injection temperature is significantly lower than the wellbore 6 ambient temperature.

A liner anchor 3 is provided to resist the tendency of the liner 4 to change dimension due to temperature changes. While shown schematically, the anchor 3 can comprise a plurality of pistons 9 that can have blunt or sharp ends 10 for abutting or penetrating the surrounding wellbore 6. The pistons 9 can be in a preset pattern or randomly located. They can be concentrated on liner 4 adjacent portions of the wellbore 6 where they will get the best grip to prevent shrinkage or expansion of liner 4 that is temperature induced from the injection fluid 5. Preferably the pistons 9 that form the anchor are disposed in a zone that is unaffected by the injection fluid 5 temperature and as a result the anchor 9 is located remotely and operated together or independently of the packers 2. The pistons can abut the wellbore wall or penetrate it or a combination of the two. The amount of gripping force on the wellbore 6 can be varied by regulating the pressure within lower end 11 of liner 4. The lower end 11 can be isolated from uphole portions of liner 4 so that a different pressure can be applied to the pistons 9 as compared to the pressure developed for the injection. This can be accomplished with a downhole pump and or pressure intensifier shown schematically as arrow 12 that boost downhole pressure for the isolated lower end 11. Alternatively, an internal tubular can extend from the surface to the lower end with some type of isolator so that the pressure or fluid used to power the pistons 9 can be the same or different than the injected fluid 5.

As shown in FIG. 1, the liner hanger 1 and the pistons 9 prevent the liner 4 between them from getting longer or shorter depending on which direction the injection fluid changes the ambient well temperature when no injection is taking place. Normally, injection will cool the liner 4, tending to shorten it. The liner hanger 1 and the pistons 9 which also serve as an anchor will minimize or prevent axial dimension change of the liner 4 that could damage the packers 2 or cause them to lose their zone isolating seal.

As shown in FIG. 1, the liner hanger 1 and the pistons 9 prevent the liner 4 between them from getting longer or shorter depending on which direction the injection fluid changes the ambient well temperature when no injection is taking place. Normally, injection will cool the liner 4, tending to shorten it. The anchors 1 and 9 will minimize or prevent axial dimension change of the liner 4 that could damage the packers 2 or cause them to lose their zone isolating seal.

Figure 2:
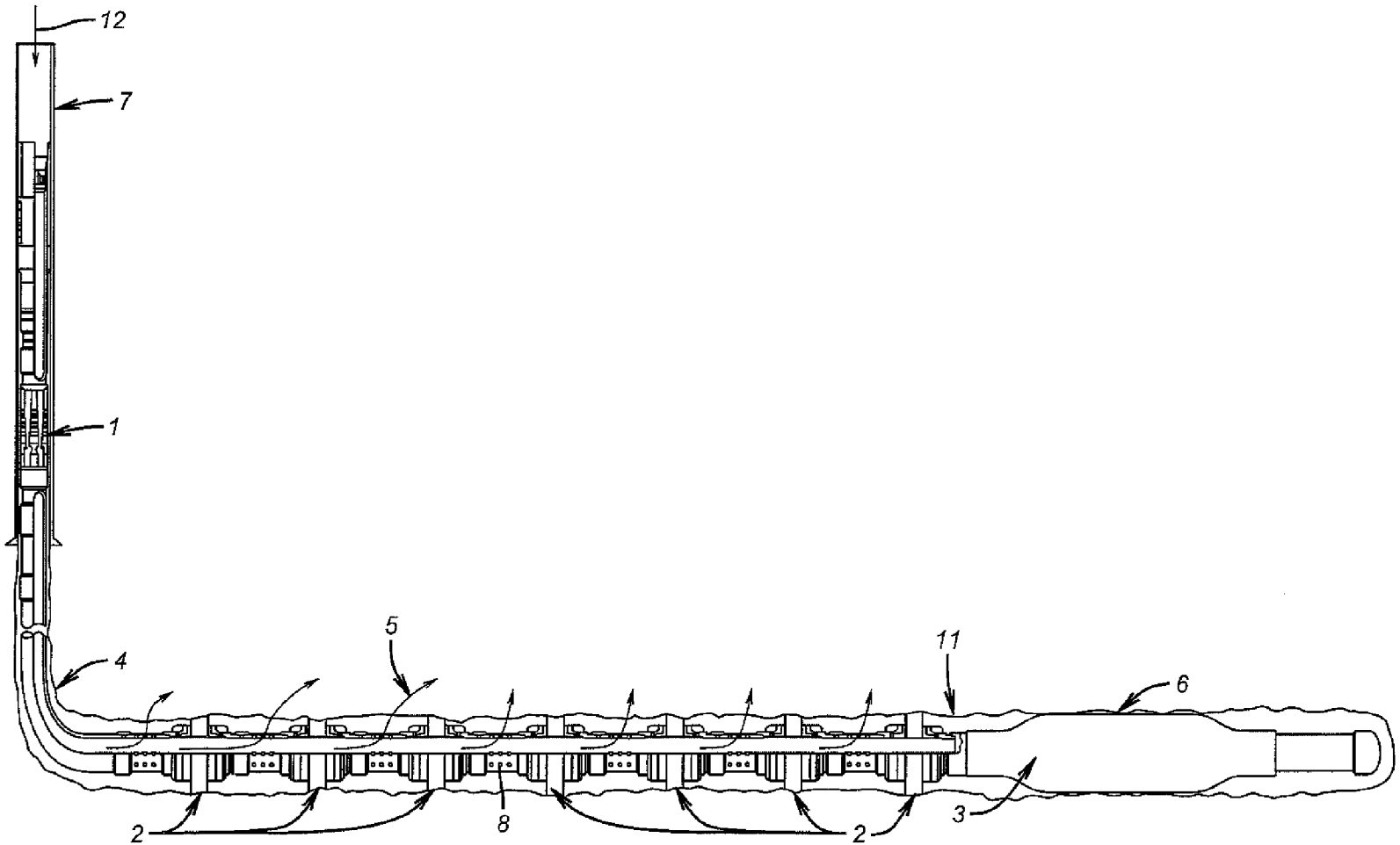
FIG. 2 is the view of FIG. 1 with tubular expansion used as the anchor.

While the lower anchor has been described as pistons 9 anchoring in open hole, other types of packers that are operative in open hole can be used instead. For example, one or more cement inflated packers can be used as an alternative or in combination with the pistons 9. Other options can be gripping devices mounted to the liner on linkages that can be extended after being run into position. The actuation systems for the anchor 9 can be hydraulic, mechanical, hydrostatic, chemical reactions or equivalent systems that provide the requisite energy to set an anchor. The tubular itself can be expanded and serve as the anchor, as shown in FIG. 2. The tubular can have external projections or gripping devices that can get the desired grip in the formation.

Those skilled in the art will appreciate that recognition of the thermal stresses from injection operations or other downhole procedures that could cause damage to downhole equipment because of dimensional changes are minimized if not eliminated with the present invention that counteracts fully or at least partially the response to such a thermal stress, i.e. a change in axial dimension. Specific anchoring techniques are within the scope of the invention as well as other variations discussed above. The uphole anchor 1 need not be a liner hanger. Another equivalent device could be used. Anchor 1 can be similar to or different than anchor 9. Those skilled in the art will recognize that there will be more options for anchor 1 since it grips within a tubular as opposed to anchor 9 that has to grip in open hole.

The above description is illustrative of the preferred embodiment and many modifications may be made by those skilled in the art without departing from the invention whose scope is to be determined from the literal and equivalent scope of the claims below.

We claim:

1. A downhole from a surface completion method in an open hole, comprising:

running an apparatus into at least one producing zone of an open hole wellbore defined by an open hole wellbore wall, said apparatus comprising at least one open hole seal mounted on an exterior of a tubular to engage the open hole wellbore wall to isolate the at least one zone, said tubular further comprising at least one opening thereon into said zone, said opening being operable for access to said zone when isolated by said seal;

anchoring the tubular exterior to the open hole wellbore wall at least at one location remote from the seal and outside said isolated one and further from the surface than said zone with an anchor located on a portion of the tubular that has no openings on the opposite side of said anchor from said seal;

providing as said anchor a plurality of spaced apart anchor members that are extendable from the tubular anchor to engage the open hole while leaving gaps between said tubular and the open hole or using expansion to the wall of the open hole of said tubular itself as said anchor;

flowing fluid through said opening that creates a thermal stress in said tubular sufficient to dislodge or damage said seal or make said seal lose its grip if said tubular was not restrained by said anchor.

2. The method of claim 1, comprising:

providing a packer as said seal;

inducing a temperature change in the tubular with the packer set in the wellbore;

locating said anchor on said tubular in a location away in the wellbore so as to be unaffected by said inducing a temperature change.

3. The method of claim 1, comprising:

pressure driving said anchor members into contact with the wellbore wall.

4. The method of claim 3, comprising:

penetrating the wellbore wall with said anchor members.

5. The method of claim 1, comprising:

locating said anchor members in a predetermined layout on said tubular.

6. The method of claim 1, comprising:

modulating the grip of said anchor members by varying the pressure used to drive them toward the wellbore wall.

7. The method of claim 1, comprising:

pumping an injection fluid into said isolated zone to accomplish axial dimensional change in the tubular.

8. The method of claim 7, comprising:

using a different pressure for injecting into said isolated zone as compared to the pressure to extend said anchor members.

9. The method of claim 7, comprising:

using different fluids for said injection and for extending said anchor members.

10. The method of claim 1, comprising:

anchoring the tubular above and below a packer where the anchor above is to another tubular and the anchor below is in the open hole.

11. The method of claim 10, comprising:

using a plurality of packers to define a plurality of zones where axial dimensional change in the tubular is induced from pumping injected fluid through openings in the tubular between pairs of packers.

12. The method of claim 1, comprising:

using pistons for said anchoring.

13. The method of claim 1, comprising:

inducing a temperature difference of greater than 50 degrees Centigrade.

14. The method of claim 1, comprising:

anchoring to resist a thermally induced force in said tubular of greater than 50,000 pounds.

15. The method of claim 1, comprising:

mechanically driving said anchor members into contact with the wellbore wall.

* * * * *